United States Patent [19]

Harbulak et al.

[11] 4,048,006

[45] Sept. 13, 1977

[54] STRIPPING OF ELECTROPLATED NICKEL-IRON ALLOYS

[75] Inventors: Edward Paul Harbulak, Allen Park; Ronald J. Lash, Warren, both of Mich.

[73] Assignee: M&T Chemicals Inc., Greenwich, Conn.

[21] Appl. No.: 602,141

[22] Filed: Aug. 5, 1975

[51] Int. Cl.[2] ..... C09K 13/00; C23F 1/00

[52] U.S. Cl. ..... 156/664; 252/79.1

[58] Field of Search ..... 156/18, 7, 656, 664; 252/79.1, 79,4; 134/29; 75/97 R, 97 A, 119, 105, 118 R

[56] References Cited

U.S. PATENT DOCUMENTS

| | | | |
|---|---|---|---|
| 2,200,486 | 5/1940 | Burdick | 75/97 A |
| 2,937,940 | 5/1960 | Weisberg et al. | 134/29 |
| 3,102,808 | 9/1963 | Weisberg et al. | 75/97 R |
| 3,163,524 | 12/1964 | Weisberg et al. | 75/97 R |
| 3,351,556 | 11/1967 | Tsourmas | 75/97 |
| 3,958,984 | 5/1976 | Fountain | 156/656 |

OTHER PUBLICATIONS

Hackh's Chemical Dictionary, McGraw-Hill Book Co., 4 Ed., pp. 3–4, 24–25, 160–161, 376–377, 676, 677.

*Primary Examiner*—Charles E. Van Horn
*Assistant Examiner*—Jerome W. Massie
*Attorney, Agent, or Firm*—Kenneth G. Wheeless; Robert P. Auber; Robert Spector

[57] ABSTRACT

A composition and process for selectively removing nickel-iron alloys from a metal substrate which comprises contacting said metal surface with an aqueous bath containing:

a. at least one nitro substituted organic compound containing at least one solubilizing group;
b. at least one organic amine or polyamine or substituted amine or polyamine; and
c. at least one aliphatic carboxylic acid or salt thereof, or a compound which will yield said carboxylic acid or salt thereof in solution, further characterized in that said aliphatic carboxylic acid or salt thereof additionally contains at least one substituent group selected from $-NH_2$ or quaternary amine salts thereof, -OH, or -SH.

By nickel-iron alloy deposit is meant a deposit containing from about 5 to 90 percent by weight iron with that portion which is not iron being primarily nickel or nickel and cobalt. Although small amounts of impurities such as copper, zinc, cadmium, lead, etc. may also be present, the major constituents of the alloy are nickel and iron.

43 Claims, No Drawings

STRIPPING OF ELECTROPLATED NICKEL-IRON ALLOYS

This invention relates to compositions and methods for stripping nickel-iron alloys from metal substrates, particularly from steel substrates.

BRIEF DESCRIPTION

This invention is a composition and process for selectively removing nickel-iron alloys from a metal substrate which comprises contacting said metal surface with an aqueous bath containing:

a. at least one nitro substituted organic compound containing at least one solubilizing group;
b. at least one organic amine or polyamine or substituted amine or polyamine; and
c. at least one aliphatic carboxylic acid or salt thereof, or a compound which will yield said carboxylic acid or salt thereof in solution, further characterized in that said aliphatic carboxylic acid or salt thereof additionally contains at least one substituent group selected from $-NH_2$ or quaternary amine salts thereof, -OH, or -SH.

By nickel-iron alloy deposit is meant a deposit containing from about 5 to 90 percent by weight iron with that portion which is not iron being primarily nickel or nickel and cobalt. Although small amounts of impurities such as copper, zinc, cadmium, lead, etc. may also be present, the major constituents of the alloy are nickel and iron.

BACKGROUND OF THE INVENTION

Ever since it has been possible to electroplate objects, it has been desirable to be able to remove the electroplated deposit in order to salvage those objects which might have been unsatisfactorily plated. In the case of nickel plating, a number of methods for removing nickel deposits can be found in the technical and patent literature. However, with the recent introduction of commercially acceptable bright nickel-iron alloy electrodeposits (as for example exemplified by U.S. Pat. Nos. 3,795,591 and 3,806,429 to Clauss et al. or 3,804,726 to Passal), the stripping methods which had been successful for removing nickel deposits have proved to be ineffective in removing nickel-iron alloy deposits. Thus, it has not been possible to easily, rapidly or satisfactorily remove these new decorative nickel-iron deposits. This invention describes a method for the rapid and efficient removal of nickel-iron deposits, so that objects which for one reason or another have been unsatisfactorily plated with a nickel-iron alloy, may be stripped of the nickel-iron alloy deposit and salvaged.

Heretofore, it has been possible to strip nickel deposits (whether electrodeposits or electroless) from a ferrous basis metal such as steel or iron because the nickel deposit was sufficiently different chemically and/or electrochemically from the ferrous basis metal so that the stripping action was confined to the nickel deposit and did not attack the ferrous basis metal. However, with the introduction of commercially successful nickel-iron alloy deposits, particularly those with substantial proportions of iron (e.g. 5% or more), the deposit is more chemically and/or electrochemically similar to the ferrous basis metal on which the nickel-iron alloy may be electrodeposited. Thus, those strippers which might be able to dissolve and strip the nickel-iron alloy deposit, cannot differentiate between a ferrous basis metal and the deposit, and thus also dissolve and attack the ferrous basis metal with subsequent damage and/or destruction of the ferrous object which it is desired to strip. Conversely, those stripping solutions which heretofore have successfully been used to strip nickel are ineffective in stripping the new nickel-iron alloy deposits. As a result, a satisfactory method for stripping nickel-iron alloy electrodeposits has not been available.

DETAILED DESCRIPTION

This invention is a composition and process for selectively removing nickel-iron alloys from a metal substrate which comprises contacting said metal surface with an aqueous bath containing:

a. at least one nitro substituted organic compound containing at least one solubilizing group:
b. at least one organic amine or polyamine or substituted amine or polyamine; and
c. at least one aliphatic carboxylic acid or salt thereof, or a compound which will yield said carboxylic acid or salt thereof in solution, further characterized in that said aliphatic carboxylic acid or salt thereof additionally contains at least one substituent group selected from $-NH_2$ or quaternary amine salts thereof, -OH, or -SH.

By nickel-iron alloy deposit is meant a deposit containing from about 5 to 90 percent by weight iron with that portion which is not iron being primarily nickel or nickel and cobalt. Although small amounts of impurities such as copper, zinc, cadmium, lead, etc. may also be present, the major constituents of the alloy are nickel and iron.

Typical nitro substituted organic compounds are mono or poly nitro substituted benzene rings containing one or more solubilizing groups such as carboxylic or sulfonic acids, etc., for example:

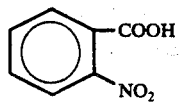

o-nitrobenzoic acid

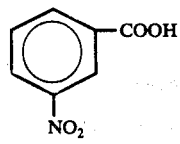

m-nitrobenzoic acid

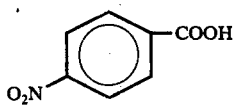

p-nitrobenzoic acid

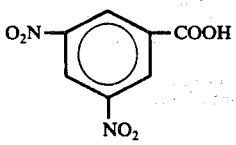

-continued 3,5-dinitrobenzoic acid

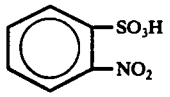

o-nitrobenzene sulfonic acid

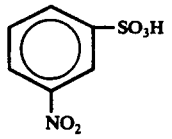

m-nitrobenzene sulfonic acid

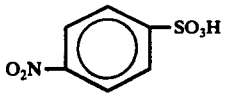

p-nitrobenzene sulfonic acid

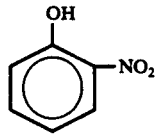

o-nitrophenol

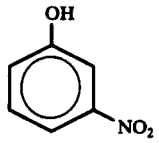

m-nitrophenol

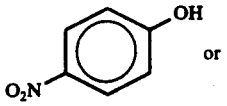

or p-nitrophenol

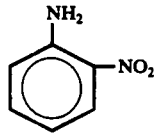

o-nitroaniline

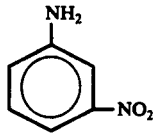

m-nitroaniline

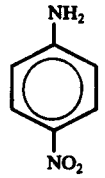

p-nitroaniline

It is understood that salts of the above acids may be used instead of the free acid, for example, $Na^+$, $K^+$, $Li^+$, $NH_4^+$, etc.

Of the above compounds, para- and meta-nitrobenzoic acid are particularly advantageous because of their efficacy and ready commercial availability.

Typical operable organic amines or polyamines or substituted amines or polyamines are exemplified by the following list:

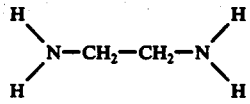

ethylenediamine

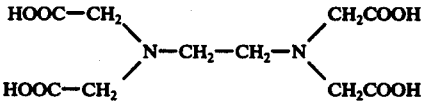

ethylenediaminetetraacetic acid

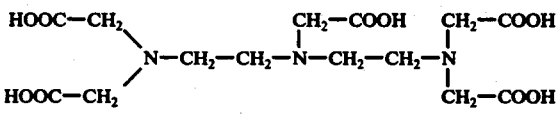

diethylenetriaminepentaacetic acid

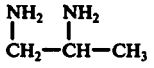

1,2-diaminopropane

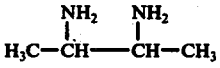

2,3-diaminobutane

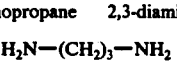

1,3-diaminopropane

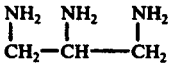

1,2.3-triaminopropane

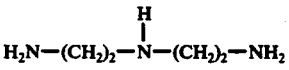

diethylenetriamine

It is understood that salts of the above acids or quaternary salts of the amine groups may be used instead of the free acid or amine.

Of the above compounds, ethylenediamine and ethylenediaminetetraacetic acid are especially useful.

Substituted carboxylic acids or salts thereof, of the type proposed for item "c" are aliphatic mono or poly carboxylic acids containing at least one substituent where the substituent groups are selected from one or more of the following:

$-NH_2$, or quaternary amine salts thereof (such as $-NH_3^+Cl^-$), -OH or -SH. Typical examples of suitable substituted carboxylic acids or salts thereof are:

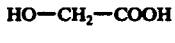

glycolic acid

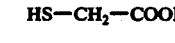

thioglycolic acid

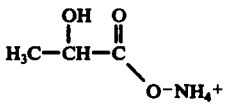

ammonium lactate

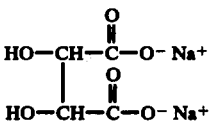

sodium tartrate

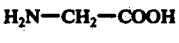

glycine

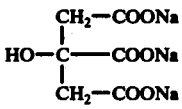

sodium citrate

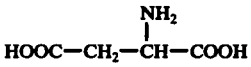

aspartic acid

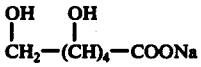

sodium gluconate

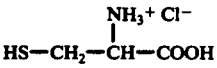

cysteine hydrochloride

Of the above typical substituted carboxylic acids or salts thereof, citric acid, or citrate salts, glycine and its salts and lactic acid or lactate salts are especially useful in the operation of this invention.

A combination of at least one compound selected from each of the following groups, a, b, and c, will effectively remove a nickel-iron alloy deposit from a ferrous object, without etching, dissolving or attacking said ferrous object.

In order to strip or remove a nickel-iron alloy deposit containing up to about 90% iron from a ferrous basis metal according to the various aspects of this invention, it is necessary to prepare an aqueous solution, selecting at least one ingredient from each of the following classes of materials:

a. A nitro substituted organic compound further characterized in that it contains at least one solubilizing group.
b. An organic amine, polyamine or substituted amine or polyamine.
c. An aliphatic carboxylic acid or salt thereof, or a compound which will give said carboxylic acid or salt thereof in solution, further characterized in that it additionally contains at least one substituent group selected from $-NH_2$, or quaternary amine salts thereof, -OH or -SH.

The purpose of the nitro substituted organic compounds of group (a) (a good example being para-nitrobenzoic acid) is to oxidize the nickel-iron alloy deposit. Suitable concentration ranges for the organic nitro compounds may be from about 0.015–2.2 moles/l, preferably about 0.06–1.5 moles/l and most preferred about 0.1 to 0.8 moles/l.

The organic amine or polyamines of group (b) function as complexing agents for the nickel ions, provide a buffering action to stabilize the pH of the solution and, most importantly, are active in preventing etching of a ferrous basis metal which otherwise might be attacked by the organic nitro compounds. Operable concentration ranges for the organic amines or polyamines are from 0.015 to 7 moles/l, preferably about 0.03 to 5 moles/l and most preferred 0.05 to 4 moles/l.

The aliphatic carboxylic acids of group (c) function as complexing agents for the oxidized nickel and iron and thus help solubilize the nickel and iron ions and assist in their removal from the surface of the deposit so that the organic nitro oxidizing agents can function efficiently. Operable concentration ranges for the carboxylic acids or salts thereof are from 0.06 moles/l to saturation, preferably about 0.13 to 5 moles/l and most preferred about 0.19 to 4 moles/l.

Since the chemical reaction proceeds more rapidly at higher temperatures, it is advantageous to operate the nickel-iron stripping solutions of this invention at elevated temperatures. In addition, when using the various ingredients at the higher concentration ranges, limited solubility may require operation at above room temperatures. Suitable temperatures may range from about 30° C. to boiling. Boiling solutions, however, evaporate rapidly thus necessitating frequent additions of water as well as posing other problems; therefore, a range of 60° C. to 90° C. provides a useful compromise which gives an efficient rate of stripping without excessive loss of solution or other attendant problems of boiling solutions.

The pH of the solution has an important role in the efficient operation of this invention. If the pH is below about 7, the stripping action of the solution is not impaired; however, the basis metal may etch as it becomes exposed to the oxidizing action of the organic nitro compounds. Conversely, if the pH is about 10 or higher, the stripping action may be completely inhibited. Therefore, the pH is desirably maintained between about 6 to 10 and preferably between about 7 to 9. The pH may be adjusted by appropriate additions of acids and bases. For example, sulfuric or hydrochloric acid and sodium or ammonium hydroxide may be conveniently used to lower or raise the operating pH of the stripping solution. It is also advantageous to measure the pH of the solution at the operating temperature.

Although this invention has been described in terms of stripping a nickel-iron deposit from a ferrous basis metal, it will be readily apparent to those skilled in the art that brass or copper or other copper alloys can also serve as a suitable basis metal for nickel-iron alloy deposits. Since these metals may be readily etched by the action of the stripping solutions described herein, it is advantageous to additionally include inhibitors to the formulations of this invention. These inhibitors are most suitably sulfur compounds of the type listed in U.S. Pat. No. 3,102,808. Typical examples are diethyldithiocarbamate, thiourea, sodium sulfide, etc.

The following examples will further serve to illustrate the operation of this invention to those skilled in the art. However, these examples are not meant to limit the scope of the invention.

EXAMPLE 1

An aqueous solution was prepared using meta-nitrobenzoic acid: 0.48 moles/l
ethylenediamine: 2.93 moles/l.

A steel panel, plated with a bright nickel-iron alloy electrodeposit to an average thickness of 8 microns, which on analysis was found to contain 48.9% Fe in the deposit, was immersed in the above solution which was maintained at a temperature of 80° C. After 2 hours, the deposit was somewhat discolored but no evidence of stripping was observed.

EXAMPLE 2

An aqueous solution was prepared according to the following formulation:

meta-nitrobenzoic acid: 0.48 moles/l
ethylenediamine: 2.93 moles/l
sodium gluconate: 0.23 moles/l
sodium citrate dihydrate: 0.17 moles/l.

A nickel-iron alloy electrodeposit containing 48.9% iron plated to an average thickness of 8 microns directly on steel was immersed at 80° C in this solution for 4 hours, after which time the deposit was found to be stripped from the basis metal and the basis steel was not etched. (Compare the results with Example 1.)

EXAMPLE 3

An aqueous solution was prepared according to the following formulation:

meta-nitrobenzoic acid: 0.48 moles/l
ethylenediamine: 0.75 moles/l
ammonium lactate: 1.12 moles/l.

A nickel-iron alloy electrodeposit containing 50% iron plated to an average thickness of 8 microns directly on steel was immersed at 80° C in this solution for 1 hour. After this time the deposit had been stripped off and only a black smut remained which was easily wiped off.

EXAMPLE 4

An aqueous solution was prepared according to the following formulation:

para-nitrobenzoic acid: 0.48 moles/l
ethylenediamine: 0.75 moles/l
citric acid (anhydrous): 0.52 moles/l
$NH_4OH$ added to adjust pH to 8 electrometric.

A nickel-iron alloy electrodeposit containing 42% iron and plated to an average thickness of 8 microns, directly on steel, was immersed in the above solution at a temperature of 80° C. The deposit was completely stripped off within one hour with no attack on the basis metal.

EXAMPLE 5

An aqueous solution was prepared according to the following formulation:

para-nitrobenzoic acid: 0.48 moles/l
ethylenediamine: 0.75 moles/l
citric acid (anhydrous): 0.52 moles/l
NaOH added to adjust pH to 8 electrometric.

A nickel-iron alloy electrodeposit containing 42% iron and plated to an average thickness of 8 microns, directly on steel, was immersed in the above solution at a temperature of 80° C. The deposit was completely stripped off in one hour with no attack of the basis metal.

EXAMPLE 6

An aqueous solution was prepared according to the following formulation:

meta-nitrobenzoic acid: 0.48 moles/l
ethylenediamine: 0.75 moles/l
citric acid (anhydrous): 0.52 moles/l
NaOH to give a pH of 11 electrometric.

A nickel-iron alloy electrodeposit containing 42% iron and plated to an average thickness of 8 microns, directly on steel, was immersed in the above solution at a temperature of 80° C. After 40 minutes of immersion there was no evidence of stripping. The solution pH was then lowered to 8.0 electrometric with sulfuric acid. After one hour additional immersion at pH 8.0 the deposit was stripped to the basis metal, which was not etched, but was covered with a loose black smut which was easily removed by cleaning the part anodically in a commercial alkaline steel cleaner.

EXAMPLE 7

An aqueous solution was prepared according to the following formulation:

meta-nitrobenzoic acid: 0.24 moles/l
ethylenediamine: 0.375 moles/l
glycine: 1.33 moles/l.

A nickel-iron alloy electrodeposit containing 42% iron and plated to an average thickness of 8 microns, directly on steel, was immersed in the above solution at a temperature of 80° C. After 1½ hours of immersion the deposit was stripped off the basis metal and a loosely adherent, easily removed, black film or smut remained.

EXAMPLE 8

An aqueous solution was prepared according to the following formulation:

meta-nitrobenzoic acid: 0.24 moles/l
ethylenediamine: 1.5 moles/l
sodium citrate dihydrate: 0.34 moles/l
tetra sodium ethylenediamine- tetraacetic acid: 0.24 moles/l.

A nickel-iron alloy electrodeposit containing about 30% iron, plated to an average thickness of about 5 microns directly on steel was immersed in the above solution at a temperature of 80° C. The deposit was easily stripped off and a loosely adhering black film or smut remained. These films are easily removed by anodic electrocleaning in a caustic cleaner, or pickling in mild acid may be advantageously employed to remove the film. Extended immersion time in the stripper also removes the film or smut, but mechanical or electrochemical cleaning methods are faster.

EXAMPLE 9

An aqueous solution was prepared according to the following formulation:

sodium meta-nitrobenzenesulfonate: 0.4 moles/l
ethylenediamine: 1.0 mole/l
citric acid (anhydrous): 0.86 moles/l
NaOH to give a pH of 8.5.

A nickel-iron alloy electrodeposit containing about 29% iron, plated to an average thickness of about 8 microns directly on steel was immersed in the above solution at a temperature of 80° C. The deposit was completely stripped from the basis metal in 30 minutes without etching the basis metal or leaving a black film or smut.

EXAMPLE 10

An aqueous solution was prepared according to the following formulation:

sodium meta-nitrobenzenesulfonate: 0.2 moles/l
ethylenediamine: 0.5 moles/l
citric acid (anhydrous): 0.43 moles/l
NaOH to give a pH of 9.

A nickel-iron alloy electrodeposit containing about 29% iron, plated to an average thickness of about 8 microns directly on steel was immersed in the above solution at a temperature of 80° C. The deposit was completely stripped from the basis metal in 30 minutes without etching the basis metal or leaving a black film or smut.

EXAMPLE 11

An aqueous solution was prepared according to the following formulation:

sodium meta-nitrobenzenesulfonate: 0.2 moles/l
ethylenediamine: 0.5 moles/l
citric acid (anhydrous): 0.43 moles/l
NaOH to give a pH of 9.

A nickel-iron alloy electrodeposit containing about 15% iron, plated to a thickness of about 13 microns, with a brass basis metal was immersed in the above solution at a temperature of 75° C. The deposit was completely dissolved in about 30 minutes and the brass basis metal was severely etched.

EXAMPLE 12

An aqueous solution was prepared according to the following formulation:

sodium meta-nitrobenzenesulfonate: 0.2 moles/l
ethylenediamine: 0.5 moles/l
citric acid (anhydrous): 0.43 moles/l
diethyldithiocarbamic acid sodium salt: 0.05 moles/l
NaOH to give a pH of 9.

A nickel-iron alloy electrodeposit containing about 15% iron, plated to a thickness of about 13 microns, with a brass basis metal was immersed in the above solution at a temperature of 75° C. The deposit was completely dissolved in about 30 minutes as in Example 11 above. However, the brass basis metal was not etched because of the addition of the diethyldithiocarbamate as an etch inhibitor.

Although this invention has been described with reference to specific examples, it will be apparent that various modifications may be made thereto which fall within the scope of this invention.

We claim:

1. A process for selectively removing nickel-iron alloys containing from 5% to 90% iron from the surface of a metal substrate which comprises contacting said nickel-iron alloys with an aqueous bath consisting of:

a. at least one nitro substituted organic compound containing at least one solubilizing group;
b. at least one organic amine or polyamine or substituted amine or polyamine; and
c. at least one aliphatic carboxylic acid or salt thereof, or a compound which will yield said carboxylic acid or salt thereof in solution, further characterized in that additionally said aliphatic carboxylic acid or salt thereof contains at least one substituent group selected from $-NH_2$, or quaternary amine salts thereof, -OH or -SH.

2. The process of claim 1 wherein said nitro substituted organic compound is a nitrobenzoic acid.

3. The process of claim 1 wherein said nitro substituted organic compound is a nitrobenzene sulfonic acid.

4. The process of claim 1 wherein said nitro substituted organic compound is a nitrophenol.

5. The process of claim 1 wherein said nitro substituted organic compound is a nitroaniline.

6. The process of claim 1 wherein said organic amine is ethylenediamine.

7. The process of claim 1 wherein said organic amine is ethylenediaminetetraacetic acid.

8. The process of claim 1 wherein said organic amine is diethylenetriamineepentaacetic acid.

9. The process of claim 1 wherein said organic amine is 1,2-diaminopropane.

10. The process of claim 1 wherein said organic amine is 2,3-diaminobutane.

11. The process of claim 1 wherein said organic amine is 1,3-diaminopropane.

12. The process of claim 1 wherein said organic amine is 1,2,3-triaminopropane.

13. The process of claim 1 wherein said organic amine is diethylenetriamine.

14. The process of claim 1 wherein said aliphatic carboxylic acid is glycolic acid.

15. The process of claim 1 wherein said aliphatic carboxylic acid is thioglycolic acid.

16. The process of claim 1 wherein said aliphatic carboxylic acid is lactic acid.

17. The process of claim 1 wherein said aliphatic carboxylic acid is tartaric acid.

18. The process of claim 1 wherein said aliphatic carboxylic acid is glycine.

19. The process of claim 1 wherein said aliphatic carboxylic acid is citric acid.

20. The process of claim 1 wherein said aliphatic carboxylic acid is aspartic acid.

21. The process of claim 1 wherein said aliphatic carboxylic acid is gluconic acid.

22. The process of claim 1 wherein said aliphatic carboxylic acid is cysteine.

23. A composition for selectively stripping nickel-iron alloys containing from 5% to 90% iron from the surface of a metal substrate which comprises an aqueous bath consisting of:

a. from 0.015 moles per liter to 2.2 moles per liter of at least one nitro substituted organic compound containing at least one solubilizing group;
b. from 0.015 moles per liter to 7 moles per liter of at least one organic amine, polyamine or substituted amine or polyamine; and
c. from 0.13 moles per liter to 5.0 moles per liter of at least one aliphatic carboxylic acid or salt thereof, or a compound which will give said carboxylic acid or salt thereof in solution, characterized in that said aliphatic carboxylic acid or salt thereof contains at least one substituent group selected from $-NH_2$, or quaternary amine salts thereof, or -OH.

24. The composition of claim 23 wherein said nitro substituted organic compound is a nitrobenzoic acid.

25. The composition of claim 23 wherein said nitro substituted organic compound is a nitrobenzene sulfonic acid.

26. The composition of claim 23 wherein said nitro substituted organic compound is a nitrophenol.

27. The composition of claim 23 wherein said nitro substituted organic compound is a nitroaniline.

28. The composition of claim 23 wherein said organic amine is ethylene diamine.

29. The composition of claim 23 wherein said organic amine is ethylenediaminetetraacetic acid.

30. The composition of claim 23 wherein said organic amine is diethylenetriaminepentaacetic acid.

31. The composition of claim 23 wherein said organic amine is 1,2-diaminopropane.

32. The composition of claim 23 wherein said organic amine is 2,3-diaminobutane.

33. The composition of claim 23 wherein said organic amine is 1,3-diaminopropane.

34. The composition of claim 23 wherein said organic amine is 1,2,3-triaminopropane.

35. The composition of claim 23 wherein said organic amine is diethylenetriamine.

36. The composition of claim 23 wherein said aliphatic carboxylic acid is glycolic acid.

37. The composition of claim 23 wherein said aliphatic carboxylic acid is lactic acid.

38. The composition of claim 23 wherein said aliphatic carboxylic acid is tartaric acid.

39. The composition of claim 23 wherein said aliphatic carboxylic acid is glycine.

40. The composition of claim 23 wherein said aliphatic carboxylic acid is citric acid.

41. The composition of claim 23 wherein said aliphatic carboxylic acid is aspartic acid.

42. The composition of claim 23 wherein said aliphatic carboxylic acid is gluconic acid.

43. The composition of claim 23 wherein said aliphatic carboxylic acid is cysteine.

* * * * *